US005233544A

United States Patent [19]

Kobayashi

[11] Patent Number: 5,233,544

[45] Date of Patent: Aug. 3, 1993

[54] SWING ANALYZING DEVICE

[75] Inventor: Kazutoshi Kobayashi, Tokyo, Japan

[73] Assignee: Maruman Golf Kabushikik Kaisha, Tokyo, Japan

[21] Appl. No.: 595,136

[22] Filed: Oct. 10, 1990

[30] Foreign Application Priority Data

Oct. 11, 1989 [JP] Japan ..... 1-262963

[51] Int. Cl.[5] ..... A63B 69/36; A63B 53/00

[52] U.S. Cl. ..... 364/566; 273/183.1

[58] Field of Search ..... 364/410, 566; 273/183 R, 183 D, 186 R, 186 C, 186 A

[56] References Cited

U.S. PATENT DOCUMENTS

| | | | |
|---|---|---|---|
| 3,270,564 | 9/1966 | Evans | 73/865.4 |
| 3,717,857 | 2/1973 | Evans | 340/870.13 |
| 3,788,647 | 1/1974 | Evans | 273/186 A |
| 3,806,131 | 4/1974 | Evans | 273/186 A |
| 3,945,646 | 3/1976 | Hammond | 273/186 A |
| 4,337,049 | 6/1982 | Connelly | 273/183 R X |
| 4,991,850 | 2/1991 | Wilhlem | 273/183 R |

FOREIGN PATENT DOCUMENTS

| | | |
|---|---|---|
| 61-15713 | 4/1986 | Japan . |
| 2126104 | 3/1984 | United Kingdom . |
| 8801526 | 3/1988 | World Int. Prop. O. . |

*Primary Examiner*—Jack B. Harvey
*Assistant Examiner*—Ellis B. Ramirez
*Attorney, Agent, or Firm*—Armstrong, Westerman, Hattori, McLeland & Naughton

[57] ABSTRACT

A swing analyzing device comprising swing practice equipment such as a golf club, wherein acceleration sensors are arranged on the shaft or on an axis of the swing practice equipment, or near the axis, and a dynamic quantity representing a movement of the shaft, such as an angular velocity, angular acceleration, and angle of the shaft, is calculated from an output of the acceleration sensors. The acceleration sensors are preferably arranged on the shaft in a spaced apart relationship so that directions of detecting acceleration substantially coincide with an axis of the shaft. A further acceleration sensor can be arranged on the shaft so that a direction of detecting acceleration forms a certain angle with an axis of said shaft.

12 Claims, 9 Drawing Sheets

SWING ANALYZING DEVICE

BACKGROUND OF THE INVENTION

1. Field of the Invention

The present invention relates to a swing analyzing device comprising a swing practice equipment such as a golf club or the like.

2. Description of the Related Art

Typically, a video camera is used when practicing to improve a golf swing, since a locus of a swing can be visually reproduced by a continuous or still photographic playback of pictures taken by the video camera.

Nevertheless, problems arise in the visual reproduction of a locus of a swing as a continuous photographic playback, in that it is difficult to accurately reproduce a component of a movement that is perpendicular the point from which a picture is taken, because a three-dimensional movement cannot be actually depicted, i.e., only a planar picture can be obtained, and if the body of the player is twisted, and thus a desired target portion of the body is hidden by the twisted body, it becomes impossible to show such a target portion in the picture. Also, when using a standard camera, it is difficult to take an instantaneous shot of the impact of the golf club with the golf ball, and expensive high speed cameras must be used for this purpose. Further, video cameras are not able to carry out a numerical analysis, or an analysis similar to a numerical analysis. For example, a difficulty arises when it is desired to continuously output outlines of only a locus of a golf club swing, as a picture or display wherein the background is removed (hereinafter referred to as a stick picture). In an analysis using a video camera, it is necessary to digitize a coordinate of a target portion of a moving body from the picture of the swing, and this must be repeatedly carried out at very small intervals, and such work is laborious and time consuming. Accordingly, it is impossible to display a stick picture just after a swing has been made.

Therefore, when practicing a swing, such as a golf swing, a problem arises in that analysis data cannot be obtained just after the swing has been made, and therefore, a desired improvement of a swing by practice or training of a swing is not easily obtained. Further, such a practice motion must be repeated many times, and therefore the analysis of a practice swing must be able to be made at a low cost. With the conventional methods, however, it is impossible to carry out a swing analysis at a low cost and with a real time processing.

Japanese Examined Patent Publication No. 61-15713 discloses a method of obtaining a locus of a swing of a golf club on a display, by attaching a three-axes acceleration sensor (an acceleration sensor capable of detecting accelerations in three directions X, Y, and Z) to the golf club, and calculating a displacement of coordinates at particular points during the swing, to thereby obtain a locus of a swing of a golf club.

In this swing analyzing device, a signal from the acceleration sensor denotes an acceleration on an inertia coordinate, i.e., a coordinate on a moving body, but a swing is not a linear movement, and therefore, it is impossible to obtain a locus of a swing on an absolute coordinate merely by attaching an acceleration sensor to a golf club. Also, the three-axes acceleration sensor is large and heavy, and thus the characteristics of the golf club, such as the weight and balance of the golf club, and the flexure of the shaft, are changed, and thus the swing is affected and it becomes impossible to analyze an actual swing of a standard golf club.

SUMMARY OF THE INVENTION

The object of the present invention is to provide a swing analyzing device by which a movement of a swing can be continuously measured substantially in a real time mode.

According to the present invention, there is provided a swing analyzing device comprising swing practice equipment having a shaftlike portion, at least one acceleration sensor arranged on the shaftlike portion or on an axis of the swing practice equipment, or near said axis, and an arithmetic means for calculating a dynamic quantity representing a movement of the shaftlike portion, from an output of the acceleration sensor.

With this arrangement, it is possible to directly measure the movement of the shaftlike portion of the swing practice equipment from the acceleration sensor, to input the output of the acceleration sensor at very small intervals, and to measure the movement of the shaftlike portion of the swing equipment at very short time intervals. Therefore, it is possible to sound a buzzer in accordance with a feature of the swing, or to present a stick picture on a display, in a real time procedure.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
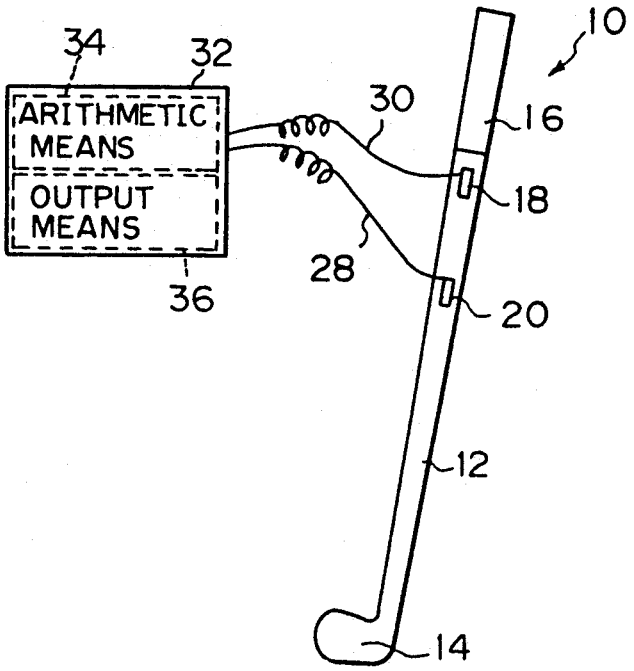
FIG. 1 is a diagrammatic view illustrating a swing analyzing device according to the first embodiment of the present invention.

FIG. 1 shows a golf club 10 as an example of a swing practice equipment. As shown in the figure, the golf club 10 has a shaft 12 and a head 14, as is well known, and a grip 16 is provided at the top of the shaft 12. In the present invention, the shaftlike portion of the swing equipment includes the shaft 12 and the grip 16.

In the embodiment shown in FIG. 1, first and second acceleration sensors 18 and 20 are attached to the shaft 12. These acceleration sensors 18 and 20 (and further acceleration sensors described later) can be of any known construction; for example, well known piezoelectric type acceleration sensors and strain gauge type (semiconductor strain gauge type) acceleration sensors. Acceleration acts in a constant direction, and thus acceleration sensors usually detect acceleration in one direction, but a two-axes or three-axes acceleration sensor is also known. Very small piezo-electric type or strain gauge type acceleration sensors are commercially available; for example, one such known sensor is 5 millimeters in diameter and 3 grams in weight. Therefore, it is possible to attach acceleration sensors 18 and 20 to the shaft 12 without disturbing the natural swing of the golf club 10.

In the embodiment shown in FIG. 1, the acceleration sensors 18 and 20 are arranged in a spaced apart relationship such that the detected directions of acceleration substantially coincide with an axis of the shaft 12.

Figure 3:
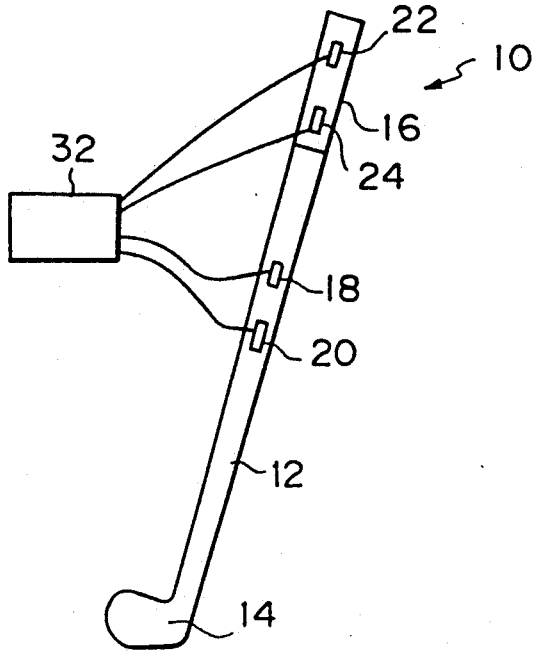
FIG. 3 is a diagrammatic view illustrating a swing analyzing device according to the third embodiment of the present invention.

In the embodiment shown in FIG. 3, third and fourth acceleration sensors 22 and 24 are arranged, in addition to the first and second acceleration sensors 18 and 20, and are also in a spaced apart relationship so that the detected directions of acceleration substantially coincide with an axis of the shaft 12.

Figure 2:
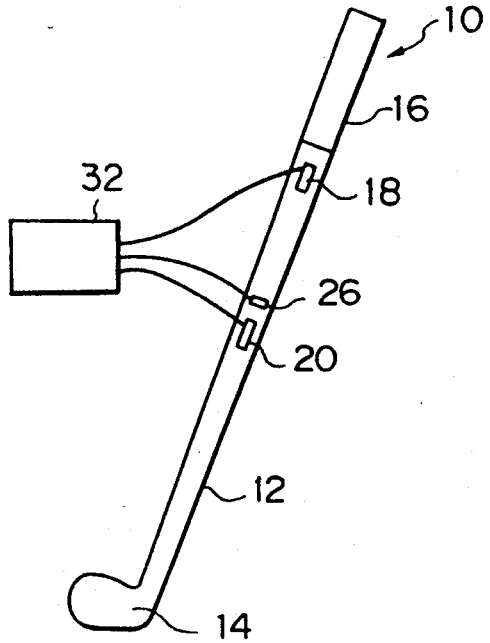
FIG. 2 diagrammatic view illustrating a swing analyzing device according to the second embodiment of the present invention.

In the embodiment shown in FIG. 2, a fifth lateral acceleration sensor 26 is arranged, in addition to the first and second acceleration sensors 18 and 20, so that a detected direction of acceleration is at an angle, preferably a right angle, to an axis of the shaft 12.

Referring to FIG. 1, the first and second acceleration sensors 18 and 20 are connected to an analyzing control unit 32 by wires 28 and 30, respectively. The analyzing control unit 32 comprises a digital computer including a central processing unit (CPU, not shown), and includes an arithmetic means 34 for calculating a dynamic quantity representing an movement of the shaft 12, from outputs of the first and second acceleration sensors 18 and 20, and further includes an output means 36, which includes, for example, a sound means such as a buzzer, or a display.

Figure 4:
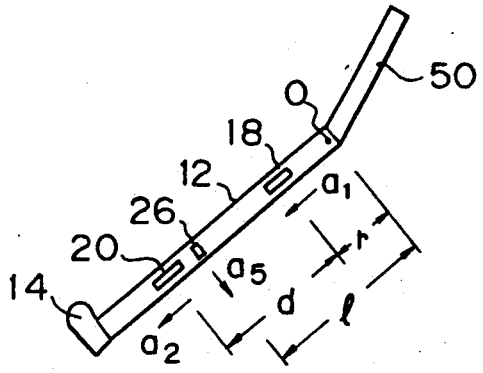
FIG. 4 is a diagrammatic view similar to FIG. 2, illustrating the positions of the acceleration sensors.

FIG. 4 shows the golf club 10 of the embodiment of FIG. 1, which is being swung by an arm 50 of a player. In this case, it can be assumed that the arm 50 of the player is a first pendulum and the golf club 10 is a second pendulum. The golf club 10 as the second pendulum is subjected to a rotational movement around a rotational center 0 near the grip 16, and to a translational movement depending on the movement of the arm 50 of the player as the first pendulum. To clarify the description, it is assumed hereinafter that the swing plane exists in a vertical plane. Also, although the exact position of the rotational center 0 changes slightly in accordance with the grip position of the arm 50 of the player, or other factors, it is assumed that the position of the rotational center 0 is constant. Note, the case wherein the position of the rotational center 0 changes is discussed later.

The first acceleration sensor 18 is located at a distance "r" from the rotational center 0, and the second acceleration sensor 20 is located at a distance "d" from the first acceleration sensor 18. The fifth acceleration sensor 26 is located at a distance "l" from the rotational center 0 of the shaftlike portion.

Figure 5:
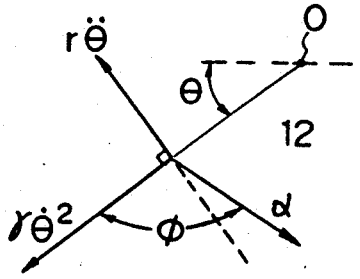
FIG. 5 is a diagrammatic view illustrating a rotational component and; a translational component of a movement of a golf club when swung.

FIG. 5 shows a dynamic relationship of the movement of the shaft 12 of the golf club 10. The shaft 12 is subjected to a rotational movement around the point 0 within the vertical swing plane at an angular velocity $\dot{\theta}$, by which the first acceleration sensor 18 is subjected to the acceleration $r\dot{\theta}^2$ to be detected by the first acceleration sensor 18. Note, the value detected by the first acceleration sensor 18 includes a translational component of the movement.

In FIGS. 4 and 5, the following characters are incorporated. $\alpha$: a value of a translational movement of the rotational center 0; $\phi$: an angle of the translational movement relative to the shaft 12; and $a_1$, $a_2$, and $a_5$: the detected values of the first, second, and fifth acceleration sensors 18, 20, and 26, respectively, and the following equations are obtained:

$$a_1 = r\dot{\theta}^2 = g\sin\theta + \alpha\cos\phi \quad (1)$$

$$a_2 = (r+d)\dot{\theta}^2 + g\sin\theta + \alpha\cos\phi \quad (2)$$

$$a_5 = -l\ddot{\theta} + g\cos\theta + \alpha\sin\phi \quad (3)$$

where "g" is an acceleration of gravity.

By subtracting the equation (1) from the equation (2), and by obtaining the square root of the result, the following equation stands $$\dot{\theta} = \sqrt{(a_2 - a_1)/d} \quad (4)$$

where $\dot{\theta}$ is an angular velocity of the shaft 12. A displaced angle $\theta$ is obtained by integrating this angular velocity $\dot{\theta}$, and an angular acceleration $\ddot{\theta}$ is obtained by differentiating this angular velocity $\theta$.

Accordingly, it is possible to obtain the angular velocity $\dot{\theta}$ of the shaft 12 from the equation (4), using the detected values $a_1$ and $a_2$. Note, there is no factor "r" in the equation (4), and accordingly, it is possible to obtain the angular velocity $\dot{\theta}$ regardless of a change of the position of the rotational center 0, by using two acceleration sensors 18 and 20 arranged in a spaced apart relationship so that detected directions of acceleration substantially coincide with an axis of the shaft 12.

The angular velocity $\dot{\theta}$ of the rotational movement of the shaft 12 can be, in principle, obtained from the detected value of only one acceleration sensor. In this case, however, the equation (4) cannot be used and a calculation may be affected by a component "r", and thus the result may include an error if the position of the rotational center 0 changes. Alternatively, if the third and fourth acceleration sensors 22 and 24 are provided in addition to the first and second acceleration sensors 18 and 20, it is possible not only to obtain the angular velocity $\dot{\theta}$ regardless of a change of the position of the rotational center 0, but also to locate the position of the rotational center 0, and thus to diagnose whether the rotational axis during the swing is undesirably moved.

Figure 8:
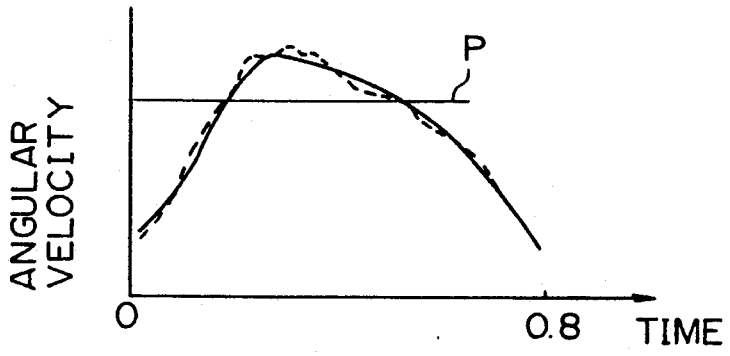
FIG. 8 is a graph of an example of an angular velocity obtained from a detected output of the acceleration sensors.

FIG. 8 is a graph of an angular velocity $\dot{\theta}$ obtained in a manner described above. The horizontal axis is a time (second) and the vertical axis is an angular velocity (radian/second). In the embodiment, a measurement is carried out during a time of 0.8 seconds per swing, and 400 samples are taken at very small intervals during that sampling time. In FIG. 8, the solid line shows an angular velocity obtained according to the present invention, and the broken line shows an angular velocity obtained according to the known analyzing means. As can be seen, the results of both cases are very similar. Note, it is possible to plot the result in a real time procedure during a swing according to the present invention, but a delay occurs before the result shown in FIG. 8 can be obtained when using the known analyzing means. Accordingly, it is also possible to set a predetermined target point P and to make an arrangement such that a buzzer is sounded when the obtained angular velocity becomes higher than the target value.

Figure 6:
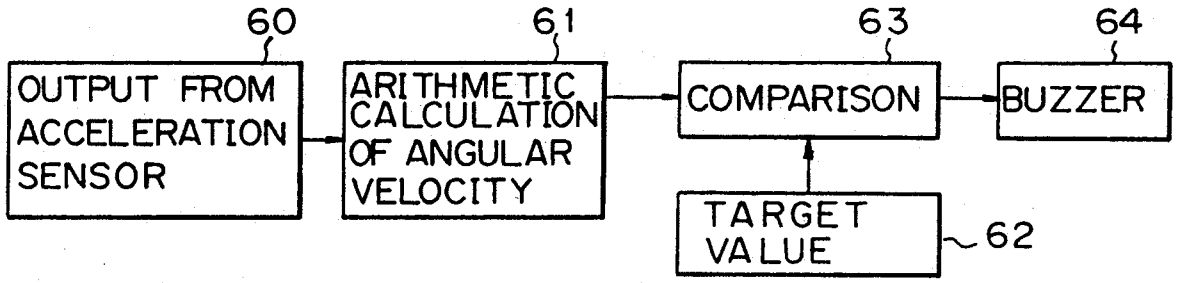
FIG. 6 is a block diagram of an embodiment for sounding a buzzer upon a detection of a predetermined output by the acceleration sensors.

FIG. 6 is a block diagram of an embodiment for sounding a buzzer. As shown in the figure, the angular velocity $\dot{\theta}$ of the shaft 12 is calculated from the detected output of the acceleration sensors 18 and 20 in the blocks 60 and 62, as described above. Then at the block 63, the result is compared to a target value P in the block 62, and when the obtained angular velocity $\dot{\theta}$ becomes higher than the target value P, a signal is delivered to a buzzer at the block 64, to thereby sound the buzzer. Accordingly, upon hearing the sound of the buzzer, the player will change the rhythm of the swing when carrying out the next practice swing.

Figure 16:
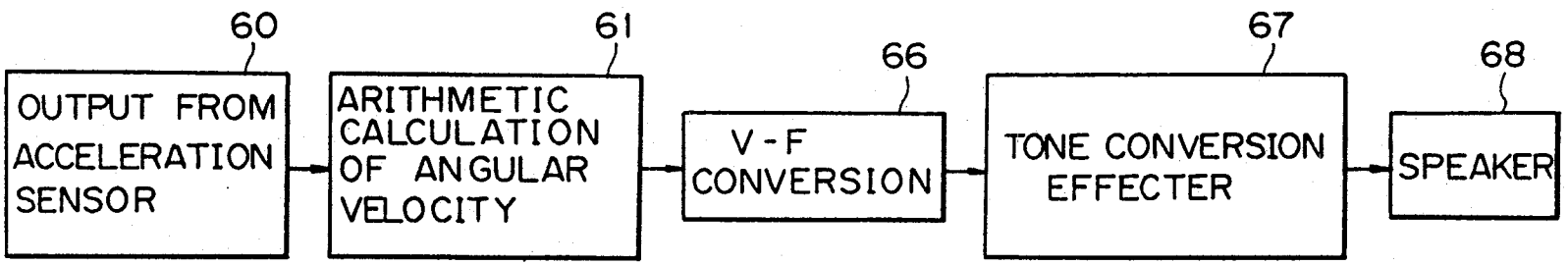
FIG. 16 is a block diagram of a modified embodiment for activating a speaker upon a detection of a predetermined output of the acceleration sensors.

FIG. 16 is a block diagram of an embodiment for activating a speaker. The angular velocity $\dot{\theta}$ of the shaft 12 is calculated, as described above, and a voltage—frequency (V—F) conversion is carried out at the block 66. Then the speaker is activated at the frequency obtained at the block 68. Also, if desired, at the block 67, the signal is passed to a tone conversion effector 67 to generate a desired tone. In this embodiment, it is possible when carrying out a practice swing, to do so in accordance with a sound having a frequency level corresponding to the acceleration of the shaft 12.

Figure 9:
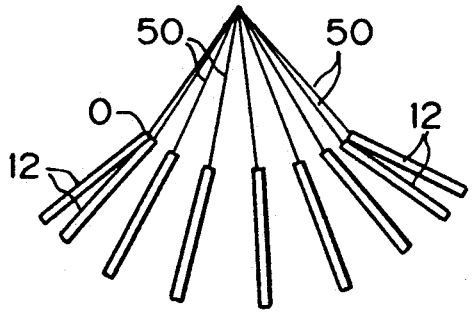
FIG. 9 shows an example of a display of a stick picture obtained in the embodiment of FIG. 7.
Figure 10:
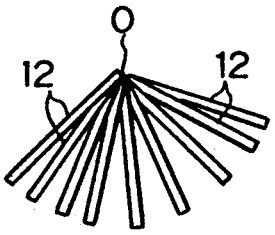
FIG. 10 shows an example of a simple stick picture.

FIG. 10 shows a stick picture presented on a display of the positions of the shaft 12 derived from the angular velocity obtained at very small intervals. This stick picture is obtained without using the detected value $a_5$ of the fifth acceleration sensor 26, and thus a component of the translational movement of the shaft 12 is not clear. The stick picture shown in FIG. 9 includes a component of the translational movement of the shaft 12 in correspondence with the movement of the arm 50 of the player, and can be obtained by a process of FIG. 7.

Figure 7:
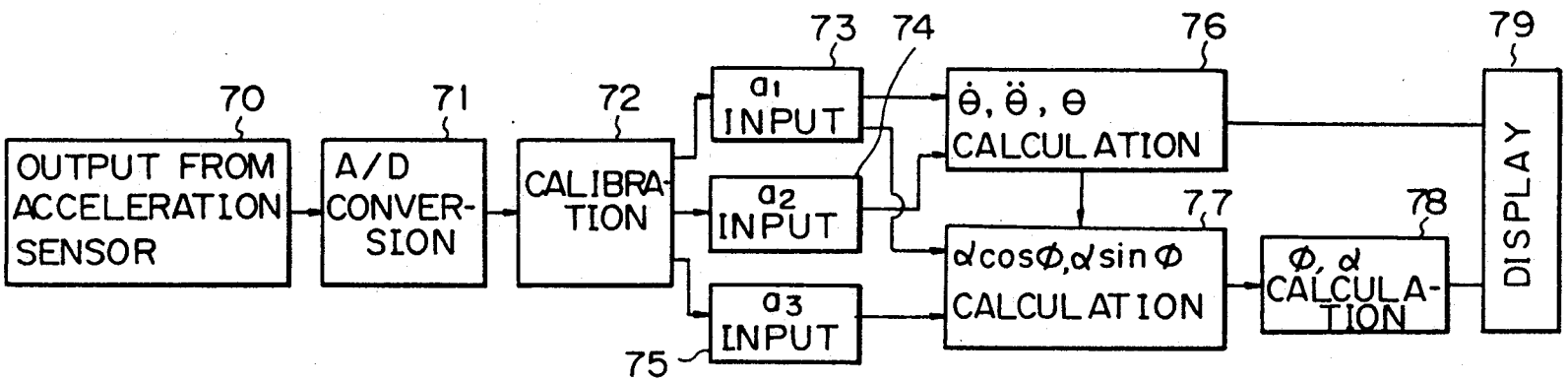
FIG. 7 is a block diagram of an embodiment for obtaining a display of a stick picture upon a detection of a predetermined output by the acceleration sensors.
Figure 11A:
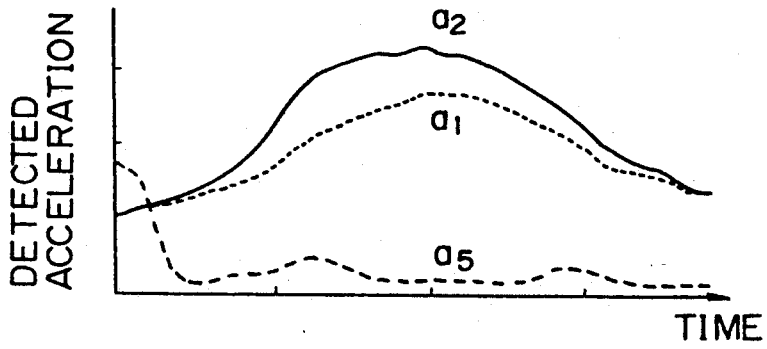
FIGS. 11A to 11D show the features of various data obtained in the former portion of the blocks of FIG. 7.
Figure 11B:
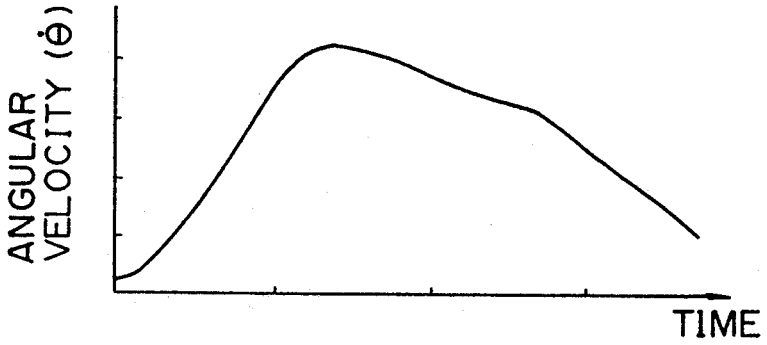
Figure 11C:
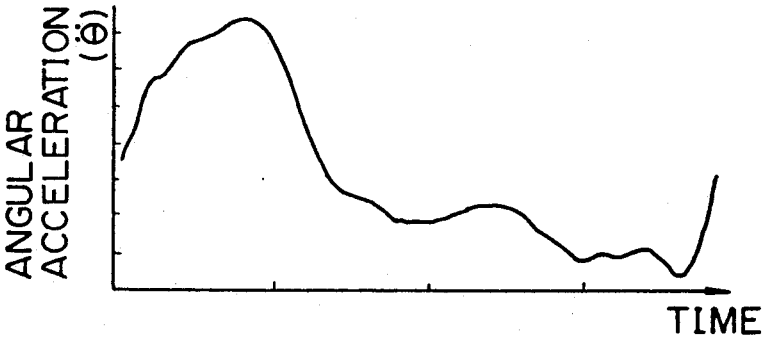
Figure 11D:
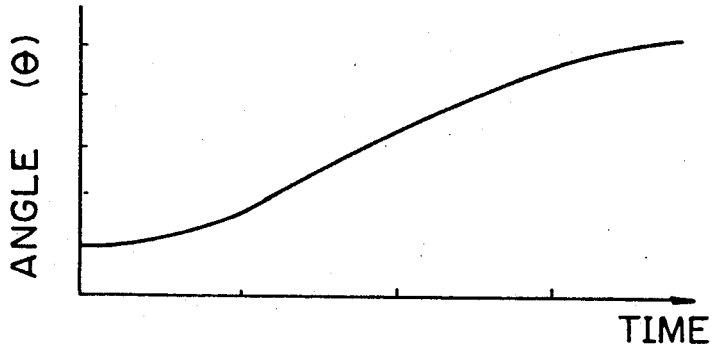

As shown in FIG. 7, outputs from the acceleration sensors 18, 20, and 26 are input to the block 70, converted to digital values by the analog/digital converter at the block 71, and calibrated at the block 72, and the detected values $a_1$, $a_2$, and $a_5$ are then stored in the respective addresses of the memory (RAM) at the blocks 73, 74, and 75, respectively. Examples of these detected values $a_1$, $a_2$, and $a_5$ are shown in FIG. 11A. Then at the block 76, the angular velocity $\dot{\theta}$ of the movement of the shaft 12 is obtained from the equation (4), the angular acceleration $\ddot{\theta}$ is obtained by differentiating this angular velocity $\dot{\theta}$, and the travelled angle $\theta$ is obtained by integrating the angular velocity $\dot{\theta}$. Examples of the angular velocity $\dot{\theta}$, the angular acceleration $\ddot{\theta}$, and the angle $\theta$ relative to the time are shown in FIGS. 11B to 11D, respectively.

Figure 12A:
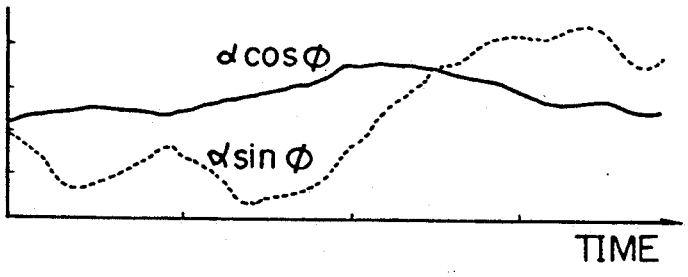
FIGS. 12A to 12C show the features of various data obtained in the latter portion of the blocks of FIG. 7.

Then, $\alpha\cos\phi$, and $\alpha\sin\phi$ are calculated at the block 77. For this calculation, the above described equations (1) and (3), or equations (2) and (3) are used. Examples of $\alpha\cos\phi$, and $\alpha\sin\phi$ are shown in FIG. 12A. Then $\phi$ and $\alpha$ are calculated at the block 78. For this purpose, it is possible use the following equations.

$$\phi=\tan^{-1}(\alpha\sin\phi/\alpha\cos\phi) \quad (5)$$

$$\alpha=\alpha\cos\phi/\cos\phi \quad (6)$$

Figure 12B:
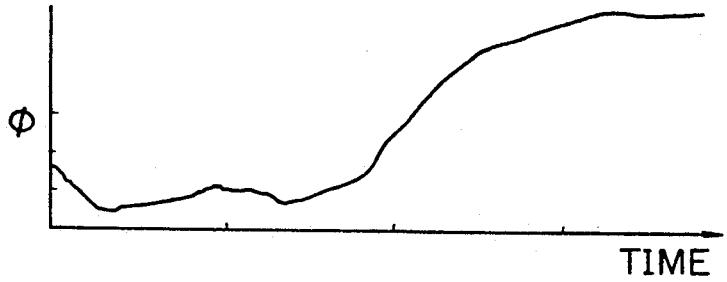
Figure 12C:
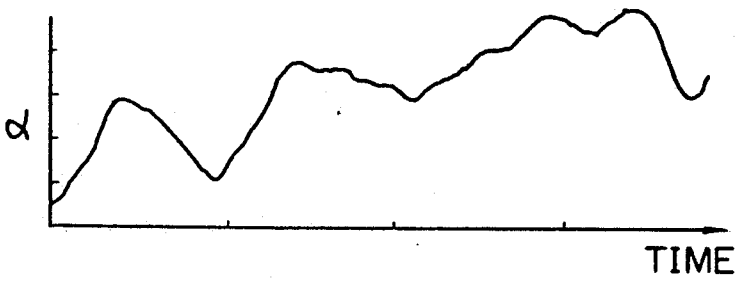

Examples of and are shown in FIGS. 12B and 12C, respectively. In this way, the magnitude $\alpha$ of the translational movement and the angle $\phi$ of the translational movement relative to the shaft 12 are obtained, these values are combined with the result of the block 76, and the stick picture shown in FIG. 9 is displayed.

Figure 13:
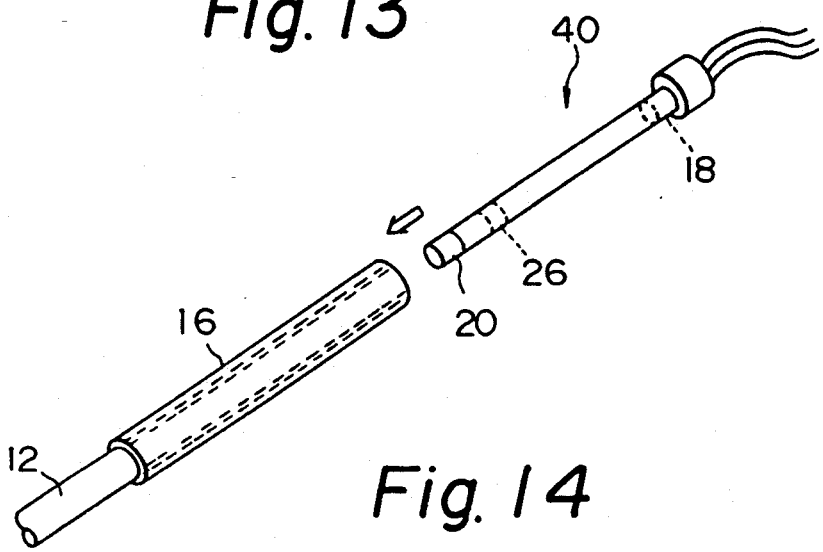
FIG. 13 shows an example of an acceleration sensor arranged in a cartridge which is inserted to the shaft.

FIG. 13 shows an example of the first, second, and fifth acceleration sensors 18, 20, and 26 when arranged in a cartridge 40 which is inserted to an interior hole in a hollow shaft 12 at the grip 16. By preparing such a cartridge 40, it is possible to interchangeably attach the first, second, and fifth acceleration sensors 18, 20, and 26 to various shafts. In this case, such shafts are not restricted to the shafts 12 of the golf clubs 10 and the cartridge 40 can be applied to any swing practice equipment provided with holes adapted to the insertion of the cartridge 40 thereto.

Figure 14:
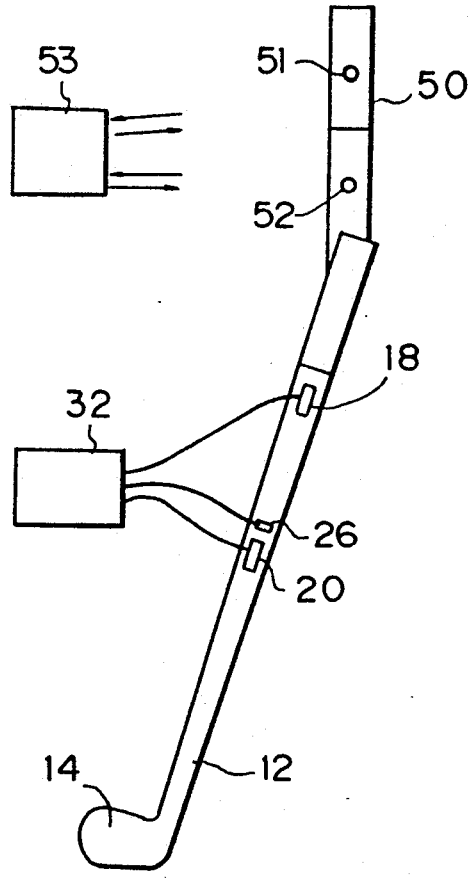
FIG. 14 shows an example of a measurement of a combined movement of the shaft and the arm.

FIG. 14 shows an embodiment comprising a combination of the device of FIG. 2 and a device for measuring the movement of the arm 50 of the player. Appropriate sensors 51 and 52, for example, a light emitting sensor or a magnetic sensor, are attached to an upper arm and a forearm of the arm 50 of the player, and a device 53 able to trace the movements of the sensors 51 and 52 is provided. One example of a known such device is called a position sensor, in which LED sensors 51 and 52 are attached to the arm 50 of the player, and the device 53 traces the travel of the light on a coordinate.

Also, it is possible to attach acceleration sensors to an upper arm and a forearm of the arm 50 of the player in the same way as they are attached to the shaft 12. It is also possible to calculate an angular velocity of the rotational movement from those sensors, in the manner described above. In addition, it is possible to obtain an inertia moment of each moving portion by a separate technique, and assuming that the inertia moment of each moving portion is already known, it is possible to calculate a torque from a multiplication of the inertia moment and tangular velocity (torque=inertia moment×angular velocity). This torque is calculated for each of the shaft 12, the upper arm, and the forearm, and the sum of the calculated torque is regarded as a torque which the player can bring into full play. As an application of this embodiment, a plurality of golf clubs 10 with acceleration sensors attached thereto are prepared, and the player swings each of the golf clubs 10, and a torque which the player can bring into full play is calculated. The golf club 10 by which the maximum torque is obtained is an optimum golf club 10 for that player. Also, a torque can be calculated during a swing while the upper arm and the forearm are substantially locked in one position, and that torque can be regarded a swing ability for the player. Also, a further sensor can be provided on the shaft 12 for detecting a torsion of the shaft 12, whereby an orientation of a face of a putter can be measured during a swing thereof.

Figure 15:
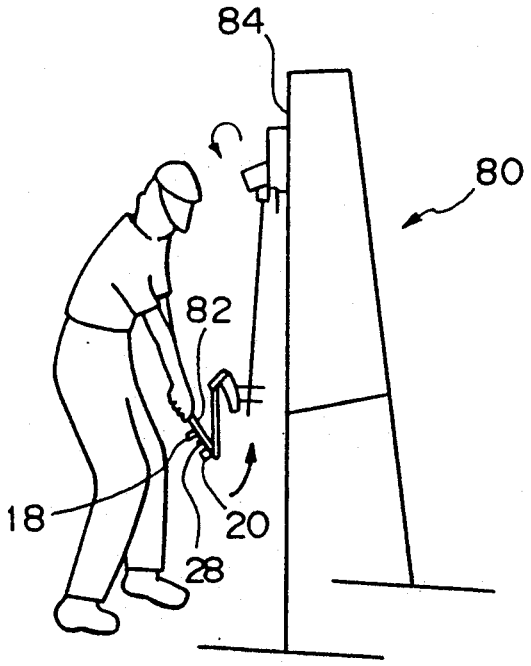
FIG. 15 is an example of a swing simulator with acceleration sensors attached thereto.

Further, it is possible to apply the present invention to a conventional swing practice equipment, and FIG. 15 shows an example whereby the present invention is applied to a conventional swing practice equipment 80, which is a known swing simulator. This swing practice equipment 80 has a shaftlike portion 82 adapted to be able to be gripped by a player, and is linked to a body of the device via rods, links, and a rotating mechanism. The player can practice a swing with this shaftlike portion 82 gripped in the hands in a manner similar to the swing of a golf club. Acceleration sensors 18, 20 and 26 are attached to this shaftlike portion 82, and it is possible to diagnose whether or not the practice swing is an effective movement, while simultaneously practicing with the swing simulator.

As described above, a swing analyzing device according to the present invention comprises swing practice equipment having a shaftlike portion, at least one acceleration sensor arranged on the shaftlike portion or on an axis of the swing practice equipment or near that axis, and an arithmetic means for calculating a dynamic quantity representing an movement of the shaftlike portion, from an output of the acceleration sensor, whereby it becomes possible to directly measure the movement of the shaftlike portion of the swing practice equipment, from the output of the acceleration sensor, to input the output of the acceleration sensor at very short intervals, and to measure the movement of the shaftlike portion of the swing practice equipment at very short time intervals, to thereby measure a movement of a swing substantially in a real time procedure.

While the invention has been particularly shown and describe din reference to preferred embodiments thereof, it will be understood by those skilled in the art that changes in form and details may be made therein without departing from the spirit and scope of the invention.

I claim:

1. A swing analyzing device comprising swing practice equipment having a shaftlike portion having a grip, acceleration sensor means arranged on said shaftlike portion or on an axis of said swing practice equipment or near said axis, and an arithmetic means for calculating a dynamic quantity representing a movement of said shaftlike portion from an output of said acceleration sensor means, wherein said acceleration sensor means comprises at least first and second acceleration sensors coaxially arranged on said shaftlike portion in a spaced apart relationship so that directions of accelerations detected thereby substantially coincide with an axis of said shaftlike portion longitudinally extending along thereof, and wherein said dynamic quantity which represents the shaftlike portion of movement is an angular acceleration of the shaftlike portion, wherein said first acceleration sensor is located at a first predetermined distance (r) from a predetermined point (o) near an end of said grip of said shaftlike portion, wherein said second acceleration sensor is located at a second predetermined distance (d) from said first acceleration sensor, and wherein said dynamic quantity is also calculated by said arithmetic means based on said first (r) and second (d) predetermined distances.

2. A swing analyzing device according to claim 1, further comprising a means for converting a dynamic quantity calculated by said arithmetic means representing a movement of said shaftlike portion into a sound, and for outputting said sound.

3. A swing analyzing device according to claim 1, wherein a means is provided for converting a dynamic quantity representing a movement of said shaftlike portion into a computer graphic and outputting said computer graphic.

4. A swing analyzing device according to claim 1, wherein a further sensor is attached to a part of a person which swings said shaftlike portion to obtain a dynamic quantity representing a movement of a body from an output of said further sensor.

5. A swing analyzing device according to claim 1, wherein said dynamic quantity calculated by said arithmetic means representing the movement includes an angular acceleration of said shaftlike portion, and wherein said arithmetic means calculates a torque which a person making a swing can bring into full play as a function of the angular acceleration to thereby measure a swing ability when a person swings while portions of the person's body is substantially located in one position.

6. A swing analyzing device according to claim 1, wherein a further sensor is provided on said shaftlike portion for detecting a torsion of said shaftlike portion, whereby an orientation of a face of a putter can be measured during a swing thereof.

7. A swing analyzing device according to claim 1, wherein said device is combined with a swing training device having a shaftlike portion, whereby a momentum is measured in a predetermined swing plane to diagnose whether or not the swing is an effective movement.

8. A swing analyzing device according to claim 1, wherein said swing practice equipment includes a plurality of different swing practice equipments having respective shaftlike portions, wherein said arithmetic means calculates a dynamic quantity representing a movement of the shaftlike portion of each swing practice equipment to thereby permit an optimum swing practice equipment to be selected for a person making a swing from the thus obtained dynamic quantity.

9. A swing analyzing device according to claim 8, wherein said dynamic quantity calculated by said arithmetic means representing a movement includes an angular acceleration of said shaftlike portion, and wherein said arithmetic means calculates a torque which a person making a swing can bring into a full play to thereby select an optimum swing practice equipment for a person making a swing from the thus obtained dynamic quantity by comparing the calculated with a torque of the respective swing practice equipment.

10. A swing analyzing device according to claim 1, wherein said acceleration sensor means comprises at least two acceleration sensors arranged on said shaftlike portion so that directions of accelerations detected thereby substantially coincide with said axis of said shaftlike portion, and a lateral acceleration sensor arranged on said shaftlike portion so that a direction of acceleration detected thereby is at an angle to an axis of said shaftlike portion.

11. A swing analyzing device according to claim 10, wherein sand angle is a right angle.

12. A swing analyzing device according to claim 11, wherein said at least one acceleration sensor comprises first and second acceleration sensors arranged on said shaftlike portion in a spaced apart relationship so that directions of acceleration detected thereby substantially coincide with an axis of said shaftlike portion, and a lateral acceleration sensor arranged on said shaftlike portion so that a direction of acceleration detected thereby is at a right angle to an axis of said shaftlike portion, with said first acceleration sensor being located at a predetermined distance (r) from the rotational center (o) of said shaftlike portion, said second acceleration sensor being located at a predetermined distance (d) from said first acceleration sensor, and said lateral acceleration sensor being located at a predetermined distance (l) from a center of rotation of said shaftlike portion, and wherein the following equations are provided:

$$a_1 = r\theta^2 - g\sin\theta + \alpha\cos\phi \quad (1)$$

$$a_2 = (r+d)\theta^2 + g\sin\theta + \alpha\cos\phi \quad (2)$$

$$a_5 = -l\theta + g\cos\theta + \alpha\sin\phi \quad (3)$$

where detected values of said first, second and lateral acceleration sensors are $a_1$, $a_2$, and $a_5$, respectively, an acceleration of a translational movement of said shaftlike portion of said swing practice equipment is $\alpha$, and an angle of the translational movement relative to said shaftlike portion is $\phi$, wherein g is gravitational acceleration, and wherein said arithmetic means calculates an angular velocity of said shaftlike portion of said swing practice equipment, an angular acceleration and an angle of the translational movement and are obtained from the relationships represented by said equations.

* * * * *